US006432228B1

(12) United States Patent
Uenishi et al.

(10) Patent No.: US 6,432,228 B1
(45) Date of Patent: Aug. 13, 2002

(54) FERRITIC STEEL SHEET EXCELLENT AT STRAIN RATE SENSITIVITY OF THE FLOW STRESS, AND AUTOMOBILE UTILIZING IT

(75) Inventors: Akihiro Uenishi; Yukihisa Kuriyama, both of Futtsu (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 09/601,272

(22) PCT Filed: Nov. 18, 1999

(86) PCT No.: PCT/JP99/06432

§ 371 (c)(1),
(2), (4) Date: Jul. 28, 2000

(87) PCT Pub. No.: WO00/32831

PCT Pub. Date: Jun. 8, 2000

(30) Foreign Application Priority Data

Nov. 30, 1998 (JP) ..... 10-338854

(51) Int. Cl.[7] ..... C22C 38/18; C22C 38/30; C22C 38/10

(52) U.S. Cl. ..... 148/333; 148/334; 148/335; 148/336; 148/330; 148/320

(58) Field of Search ..... 148/320, 330, 148/333, 334, 335, 336; 420/104, 107

(56) References Cited

U.S. PATENT DOCUMENTS 4,127,427 A * 11/1978 Hirano et al. ..... 148/333

FOREIGN PATENT DOCUMENTS

| | | |
|---|---|---|
| JP | 6-322476 | 11/1994 |
| JP | 7-34187 | 2/1995 |
| JP | 9-241788 | 9/1997 |
| JP | 9-287050 | 11/1997 |
| JP | 9-296247 | 11/1997 |
| JP | 11-080878 | 3/1999 |
| JP | 11-080879 | 3/1999 |
| JP | 2000-017385 | 1/2000 |
| WO | WO 98/23785 | 6/1998 |
| WO | WO 98/32889 | 7/1998 |
| WO | WO 98/41664 | 9/1998 |

OTHER PUBLICATIONS

E. Nakanishi, et al., Structural Failure, Product Liability and Technical Insurance, IV (1992).

Patent Abstracts of Japan, vol. 1998, No. 14, Dec. 31, 1998.

Patent Abstracts of Japan, vol. 1998, No. 4, Mar. 31, 1998.

Patent Abstracts of Japan, vol. 007, No. 209, Sep. 14, 1983.

* cited by examiner

*Primary Examiner*—Deborah Yee
(74) *Attorney, Agent, or Firm*—Kenyon & Kenyon

(57) ABSTRACT

The present invention provides a ferritic steel sheet, the quasi-static strength of which is enhanced and further the dynamic strength of which is not lowered. There is provided a ferritic steel sheet excellent at strain rate sensitivity characterized in that: Co and/or Cr are contained at pot less than 0.01 mass % and not more than 4.0 mass % in total in the state of solid solution in the ferrite phase.

8 Claims, 2 Drawing Sheets

FERRITIC STEEL SHEET EXCELLENT AT STRAIN RATE SENSITIVITY OF THE FLOW STRESS, AND AUTOMOBILE UTILIZING IT

FIELD OF THE INVENTION

The present invention relates to a steel sheet suitably used for reducing the weight of an automobile and enhancing the safety of passengers in the case of collision.

BACKGROUND ART OF THE INVENTION

In order to suppress a discharge of carbonic acid gas from an automobile engine, the weight of an automobile body has been reduced by using high strength steel sheets when the automobile body is manufactured. Further, in order to ensure the safety of passengers, investigations have been made so that not only mild steel sheets but also high strength steel sheets can be used for automobile bodies. However, the high strength steel sheet is inferior to the mild steel sheet from the viewpoint of strain rate dependency. The problem with the high strength steel sheet is described below. In the case where the high strength steel sheet is deformed at high rate of deformation corresponding to the collision of an automobile, a difference between the flow stress of the high strength steel sheet and the flow stress of the mild steel sheet becomes smaller than that in the case of static deformation conducted in a conventional tensile strength test. Therefore, the advantage of using the high strength steel sheet, the static strength of which is higher than that of the mild steel sheet, is decreased. Of course, it is very important to develop steel sheets, which has an excellent strain rate sensitivity of the flow stress, so that the safety of passengers in the case of collision and the reduction of the weight can be made compatible with each other.

In order to make up for the deterioration of the strain rate sensitivity, the present inventors took into account of the manufacturing process of an actual impact absorbing member including a press forming process, coating process and baking finishing process, and developed steel sheets, the dynamic strength of which was high after the actual impact absorbing member had gone through these processes. This technique is disclosed in Japanese Unexamined Patent Publication Nos. 9-287050 and 9-296247.

When a strain rate sensitivity of a steel sheet is not lowered in spite of an increase of a strength of the steel sheet is increased, the impact absorbing characteristic can be enhanced. However, this problem has seldom been tackled until now.

For example, Japanese Unexamined Patent Publication No. 6-322476 discloses a steel sheet for automobile use, the impact resistance of which is high, which is produced by reducing the quantities of C and N existing a state of a solid solution. According to this patent publication, only the following is disclosed. A ratio of the yield strength in the case of quasi-static deformation to the yield strength in the case of dynamic deformation is enhanced, which is shown on line 31 to 38 in the third column of page 3 in the patent publication. However, there is no description about enhancing the tensile strength in the case of deformation conducted at high strain rate.

In this connection, quasi-static deformation (static strength) is defined as deformation (strength) at the strain rate of $10^{-3}$/sec in the case of a conventional tensile test, and high strain rate deformation or dynamic deformation (dynamic strength) is defined as deformation (strength) at the strain rate of $10^{3}$/sec.

Strain rate sensitivity is defined as a difference ($\sigma d - \sigma s$) between the average stress $\sigma d$ from the nominal strain 5% to 10% in the case of deformation conducted at the strain rate of $10^{3}$/sec and the average stress $\sigma s$ in the case of deformation conducted at the strain rate of $10^{3}$/sec.

For example, as described in E. Nakanishi et. al., Structural Failure, Product Liability and Technical Insurance, IV (1992), 423, Elsevier, the strain rate sensitivity of then conventional steel sheet for automobile use is deteriorated regardless an increase in the strength, and the enhancement of the impact absorbing capacity is limited.

SUMMARY OF THE INVENTION

It is an object of the present invention to provide a ferritic steel sheet containing Co and Cr in the state of solid solution so that the static strength of a conventional steel sheet can be increased and further the enhancement of the dynamic strength cannot be decreased.

According to conventional knowledge, it is inevitable that when the strength of a steel sheet is increased, the strain rate sensitivity is deteriorated as compared with a mild steel sheet. Therefore, the effect provided by using a high strength steel sheet is reduced. However, in order to cope with the strict requirements against collision damage and in order to improve the fuel consumption, it is necessary to provide a fundamental solution.

To solve the above problems, the present inventors made investigation into the fundamental theory of deformation of steel so that the increase of strength can be compatible with the strain rate sensitivity. They researched the action and effect of elements contained in the material in the state of solid solution. As a result of the research, the present inventors found that Co and/or Cr, which exist in the state of solid solution in the ferrite phase, which are conventionally considered to have little effect on the static strength, that is, which are conventionally considered to have little capacity of enhancing the strength by forming solid solution, exert an important action on the strain rate sensitivity in the process of deformation conducted at a high strain rate.

The present invention has been accomplished the invention according to the above knowledge. The summary of the present invention is described as follows.

(1) A ferritic steel sheet excellent at strain rate sensitivity characterized in that: Co and/or Cr are contained by not less than 0.01 mass % and not more than 4.0 mass % in total in the state of solid solution in the ferrite phase of steel.

(2) A ferritic steel sheet excellent at strain rate sensitivity comprising; in terms of mass %, C: not less than 0.0001% and not more than 0.05%, Si: not less than 0.01% and not more than 1.0%, Mn: not less than 0.01% and not more than 2.0%, P: not more than 0.15%, S: not more than 0.03%, Al: not less than 0.01% and not more than 0.1%, N: not more than 0.01%, and O: not more than 0.007%, wherein Co and/or Cr are contained by not less than 0.01% and not more than 4.0% in total in the solid solution in the ferrite phase, and the remainder Fe is and unavoidable impurities.

(3) A ferritic steel sheet excellent at strain rate sensitivity according to item (2), further comprising; in terms of mass %, at least one or two of the elements of Ti: not more than 0.20%, Nb: not more than 0.20% and B: not more than 0.005%.

(4) A ferritic steel sheet excellent at strain rate sensitivity according to item (3), further comprising; in terms of mass %, at least one or two of the elements of Mo: not more than 1.0%, Cu: not more than 2.0% and Ni: not more than 1.0%.

(5) A ferritic steel sheet excellent at strain rate sensitivity comprising; in terms of mass %, C: not less than 0.05% and not more than 0.25%, Si: not less than 0.01% and not more than 2.5%, Mn: not less than 0.01% and not more than 2.5%, P: not more than 0.15%, S: not more than 0.03%, Al: not less than 0.01% and not more than 1.0%, N: not more than 0.01%, and O: not more than 0.007%, wherein Co and/or Cr are contained by not less than 0.01% and not more than 4.0% in total in the solid solution in the ferrite phase, and the remainder Fe and unavoidable impurities.

(6) A ferritic steel sheet excellent at strain rate sensitivity according to item (5), further comprising; in terms of mass %, at least one or two of the elements of Ti: not more than 0.20%, Nb: not more than 0.20%, V; not more than 0.20% and B: not more than 0.005%.

(7) A ferritic steel sheet excellent at strain rate sensitivity according to item (6), further comprising; in terms of mass %, at least one or two of the elements of Mo: not more than 1%, Cu: not more than 2% and Ni: not more than 1%.

(8) A ferritic steel sheet excellent at strain rate sensitivity according to one of items (1) to (7), wherein plating is conducted on the steel sheet.

(9) An automobile characterized in that: at least one or two of the cross member, front side member, center pillar, rocker, side roof rail and rear side member are made of a ferritic steel sheet described in one of items (1) to (8).

In the present invention, the ferritic steel sheet is defined as a hot-rolled steel sheet and a cold-rolled steel sheet except for a stainless steel sheet of austenitic and a ferritic stainless steel sheet.

In the present invention, Co contained in steel in the state of solid solution is defined as a quantity of Co obtained when the quantity of Co contained in steel in the form of carbide and nitride is subtracted from the total quantity of Co contained in steel. Also, Cr contained in steel in the state of solid solution is defined as a quantity of Cr obtained when Cr contained in steel in the form of carbide and nitride is subtracted from the total Cr content contained in steel. The total amount of each element contained in steel is found by the real time quantive analysis method, and the quantity existing in the form of carbide or nitride is found in such a manner that carbide, nitride or impurities is extracted by the electrolytic extraction method, and the thus extracted one is fused by acid or alkali and then subjected to ICP (high frequency induction plasma conbination analyzer).

THE MOST PREFERRED EMBODIMENT

Figure 1:
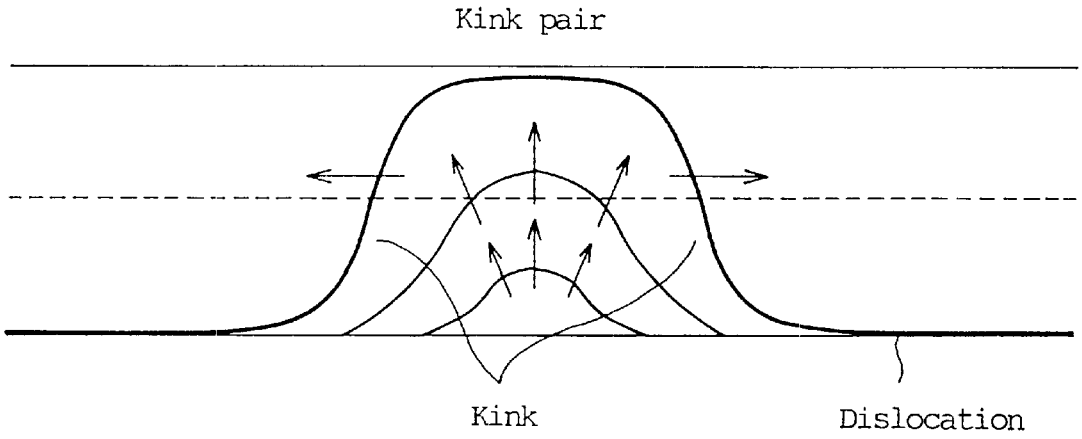
FIG. 1 is a schematic illustration showing the movement of dislocation at high strain rate.

The present invention will be explained in detail below.

The fundamental concept of the present invention is described as follows. When an element, the solution strengthening capacity of which is low, that is, an element, the difference between the atomic radius of which and the atomic radius of iron is small, is made to exist in the ferrite phase, which controls the sensitivity of flow stress upon a strain rate, in the state of solid solution, the sensitivity of flow stress upon a strain rate of a steel sheet is enhanced. The reason is explained below together with the deformation mechanism of metal conducted at a high strain rate.

In general, it is well known that flow stress of metal is expressed by the following formula.

$$\tau=\tau i+\tau e \quad (1)$$

In the above formula, $\tau i$ is referred to as an internal stress, which does not depend upon the temperature and the strain rate, and $\tau e$ is referred to as a thermal stress or effective stress, which depends upon the temperature and the strain rate. In order to be a material excellent at the impact absorbing capacity, it is necessary for the material to show a high flow stress. In order to show a high flow stress, it is ideal that both the internal stress and the effective stress are increased when the strength of the material is enhanced. However, as described before, in the case of the conventional material, when the strength of the material is enhanced, the internal stress is increased, however, the effective stress is decreased, that is, the strain rate sensitivity is deteriorated, and the enhancement of the impact absorbing capacity is limited. This mechanism had not been known until now, however, the present inventors made earnest investigation and the following results were obtained.

The deformation of material is controlled by the dislocation motion in the material. It can be considered that the flow stress is the sum total of resistance forces given to the dislocation from obstacles in the material. Whether or not the flow stress has a strain rate sensitivity is determined by whether characteristics of obstacles are at a long range or at a short range with respect to the dislocation movement.

In the case where the obstacles exist at a short range, by the assistance of thermal fluctuation, the dislocation can overcome the obstacles in a process of thermal activation. However, in the case of deformation conducted at a high strain rate or in the case of deformation conducted at a low temperature, it is difficult to obtain the assistance of thermal fluctuation to overcome the obstacles in the process of dislocation. Therefore, the flow stress is increased as compared with the flow conducted at the room temperature at a low strain rate, which is the origin of the effective stress.

On the other hand, when the obstacles exist at a long range, even if the assistance of thermal fluctuation is obtained, it almost impossible for the dislocation to overcome the obstacles with the aid of thermal fluctuation. Therefore, even when the temperature and the strain rate are changed and the influence of thermal fluctuation on the dislocation is changed, the flow stress seldom changes, which is the origin of the internal stress. The representative method of enhancing the strength is to introduce these obstacles at a long range. Specifically, the typical method of enhancing the strength is to introduce a substitution type solution element and precipitation, which increases the internal stress, that is, which increases the static strength in the case of a conventional tensile strength test.

On the other hand, the dominant short range obstacles of ferritic steel is Peierls potential which reflects the periodicity of crystal lattice, which is considered to determine the intensity of the effective stress, that is, to determine the strain rate sensitivity. In this case, it is important to know the relation between the high strength of material and the effective stress. Conventionally, it has been known, as a result of experiments, that when the strength is increased, the effective stress is decreased. However, nobody has made investigation into the relation of the above fact with Peierls potential. In this connection, the aforementioned Peierls potential is defined as follows. A movement force to the dislocation in a crystal not containing a defect except for the moving dislocation is defined as Peierls stress, and its potential is defined as Peierls potential.

A more specific relation between Peierls potential and the dislocation movement is described below. It is well known that Peierls potential in bcc metal like the ferrite phase is very high, so that it is difficult for the movement of dislocation. For the above reasons, at a low temperature, at which the contribution of thermal fluctuation is decreased, the dislocation is positioned at a root portion of Peierls potential, and only a portion, which is referred to as a kink pair, is moved to the next root portion, when it goes over the ridge portion, and after that, the kinks is moved in the traverse direction. As a result, the whole is moved as shown in FIG. 1.

The more difficult the formation and movement of the kink pair are, the higher flow stress is required. Therefore, the flow stress of the ferrite phase of iron shows the dependency upon temperature. The contribution of thermal fluctuation to the dislocation movement at a low temperature is equivalent to that at a high temperature. Therefore, in the process of deformation conducted at a high strain rates, in the same manner as that of the case of a low temperature, the flow stress is determined by the formation of the kink pair and the movement of the kinks. The dependency upon a strain rate is determined by the formation of the kink pair and the movement of the kinks.

The present inventors think that the deterioration of the strain rate sensitivity, with the increase of the quasi-static strength of materials, originates from the decrease of the energies of the formation of the kink pair and/or the movement of the kinks due to solute atoms and precipitations introduced into the phase of the ferrite phase. The solution atoms and precipitations themselves become obstacles to the dislocation and increase the internal stress, that is, the quasi-static strength is increased. On the other hand, when these obstacles are introduced, the crystal lattice is distorted at the same time, and the Peierls potential is changed, so that the kink pair can be easily formed and moved, and the effective stress is lowered. Accordingly, the dependency of flow stress upon a strain rate is lowered. This is the cause of the deterioration of the dependency of flow stress upon a strain rate.

The reasons why the present inventors paid attention to Co and Cr are described as follows. A difference between the atomic radiuses of these elements and the atomic radius of Fe is so small that (1) an influence given to the lattice in the periphery is kept minimum and the energies of formation and movement of the kink couple is not decreased, and (2) the process that the dislocation overcomes these solute atoms might be thought as a thermally activated process, though the common solute atoms are overcome in an athermal process. Due to the foregoing, it is possible to expect that the strain rate sensitivity is enhanced more than a common mild steel sheet.

As described later referring to an embodiment, the present inventors found that Co and Cr existing in the ferrite phase in the state-of solid solution enhance the strain rate sensitivity. The present inventors also found that Co and Cr existing in the state of solid solution are effective even if another strengthening mechanism exists. When Co and Cr exist in the state of solid solution, the strain rate sensitivity can be additionally enhanced as compared with the material in which Co and Cr do not exist in the state of solid solution. In other words, Co and Cr existing in the state of solid solution in the ferrite phase is a fundamental mechanism for the strain rate sensitivity exceeding the restriction of the strength of a steel sheet.

The above concept can be generally applied as long as it is applied to a steel sheet. Therefore, it is basically unnecessary to limit the strength and type of a steel sheet. However, from the viewpoint of practical use, the type of a steel sheet to which this technique is applied will be described as follows.

The type of a steel sheet includes a mild steel sheet and high strength steel sheet. Further, the type of a steel sheet includes a hot-rolled steel sheet and cold-rolled steel sheet. However, consideration should be given to keeping the ferrite phase containing Co and Cr in the state of solid solution contains carbide and nitride as small as possible, that is, consideration should be given too keeping the average free path of dislocation determined by the obstacles except for Co and Cr long, the percentage of volume high, and the maximum strain rate sensitivity exhibited in the materials, the quasi-static strength of which is the same when the particle size is small.

When the sum of Co and Cr which exist in the material in the state of solid solution is lower than 0.01%, the effect of enhancing the strain rate sensitivity is not sufficient. When the sum of Co and Cr which exist in the material in the state of solid solution exceeds 4.0%, it becomes difficult for Co and Cr to exist in the state of solid solution, and further the manufacturing cost is disadvantageously increased. For the above reasons, the sum of Co and Cr is restricted in the range from 0.01 to 4.0%.

Co and Cr in the state of solid solution can be obtained when they are added by the quantity not less than the necessary quantity which is found by the solubility product while consideration is given to the contents of C and N before Co and cr are added and the controlling the heating temperature and cooling rate.

In this connection, the reason why the absolute values of the contents of Co and Cr are not stipulated in the present invention will be described below. Concerning the addition of Co, Co perfectly forms a solid solution with Fe. Therefore, when the Co content in the state of solid solution is in the range from 0.01% to 4% which is stipulated by the present invention, Co forms a perfect solid solution with Fe, and further Co does not make a specific carbide with C and N. That is, no interaction occurs between Co and C. Therefore, concerning Co, it is unnecessary to give consideration to the necessary addition quantity which is found by the solubility product. In the same manner, concerning the addition of Cr, Cr forms a perfect solid solution with Fe in the composition stipulated by the present invention. With respect to C and N, for example, when the phase diagram of Fe-C-Cr is checked, and when the composition stipulated by the present invention is adopted, it is possible that the precipitation of chemical compound such as $(Fe, Cr)_3C$ or $(Fe, Cr)_7C_3$ is created and further other precipitation may be created. Therefore, it is impossible to use the usual formula. Accordingly, it is necessary to estimate the solubility product of each precipitation, which is predicted by various precipitation patterns. Accordingly, when the composition is determined, it is necessary to calculate the degree of solution of each element in the ferrite phase or it is necessary to estimate the degree of solution of each element by experiment.

The composition of a steel sheet stipulated by the present invention includes: a very low carbon steel sheet; IF (interstitial free) steel sheet in which solution carbon and nitrogen are fixed by Ti and Nb; low carbon steel sheet; high strength steel sheet which is strengthened by solid solution; high strength steel sheet which is strengthened by precipitation; high strength steel sheet which is strengthened by the phases other than ferrite such as stained austenite, martensite and bainite etc; and high strength steel sheet in which the above strengthening mechanisms are combined with each other.

Objects of the composition stipulated by the above item (2) are mainly a very low carbon steel sheet, low carbon steel sheet and solid solution hardened high strength steel sheet. Objects of the composition stipulated by the above item (3) are mainly an IF steel sheet and precipitation hardened high strength steel sheet. Objects of the composition stipulated by the above item (5) are mainly a solid solution hardened high strength steel sheet and transformation hardened high strength steel sheet. The composition stipulated by item (6) relates to a steel sheet in which the precipitation hardening mechanism is combined and utilized in the solid solution hardened high strength steel sheet and the transformation hardened high strength steel. Item (8) relates to a plated steel sheet. When Co and Cr are contained in the above materials in the state of solid solution, they contribute to the enhancement of the dependency of flow stress upon a strain rate.

First, how the composition of steel according to item (2) is restricted will be described below.

The reason why the lower limit of C is set at 0.0001% is that the carbon content of 0.0001% is the lower limit of steel which can be actually put into practical use. The reason why the upper limit of C is set at 0.05% is that when the carbon content exceeds 0.05%, the formability is deteriorated.

Si and Mn are respectively added at not less than 0.01% for deoxidation. The reason why the upper limits are respectively set at 1.0% and 2.0% is that when the upper limits exceed the above values, the formability is deteriorated.

P and S are impurities. The reason why the upper limits are respectively set at 0.15% and 0.03% is to prevent the deterioration of the formability.

Al is added at not less than 0.01% for deoxidation. However, when too much Al is added, the formability is deteriorated. Therefore, the upper limit of Al is set at 0.1%.

N and O are impurities. In order to prevent the formability from deteriorating, the upper limits of N and O are respectively set at 0.01% and 0.007%.

Ti, Nb and B stipulated by item (3) improve the material through the mechanisms of fixation of carbon and nitrogen, precipitation hardening and fine particle strengthening. Therefore, it is desirable that Ti, Nb and B are respectively added at not less than 0.005%, 0.001% and 0.0001%. When too much is added, the formability is deteriorated. Therefore, upper limits are set.

Next, how the composition of steel according to item (5) is restricted will be described below.

The reason why the lower limit of C is set at 0.005% is that the carbon content of 0.0001% is the lower limit of steel which can be actually put into practical use. The reason why the upper limit of the C content is set at 0.05% is that when its exceeds 0.05%, the formability is deteriorated.

Si and Mn are respectively added at not less than 0.01% for deoxidation. The reason why the upper limits are respectively set at 2.5% is that when the upper limits exceed the above values, the formability is deteriorated.

P and S are impurities. The reason why the upper limits are respectively set at 0.15% and 0.03% is to prevent the deterioration of the formability.

Al is added at not less than 0.01% for deoxidation and control of material. However, when Al too much is added, the surface property is deteriorated. Therefore, the upper limit of Al is set at 0.1%.

N and O are impurities. In order to prevent the formability from deteriorating, the upper limits of N and O are respectively set at 0.01% and 0.007%.

Ti, Nb, V and B stipulated by item (6) improve the material through the mechanisms of fixation of carbon and nitrogen, precipitation hardening and fine particle strengthening. Therefore, it is desirable that Ti, Nb, V and B are respectively added at not less than 0.005%, 0.001%, 0.01% and 0.0001%. When too much is added, the formability is deteriorated. Therefore, the upper limits are set for them.

In order to ensure the quasi-static strength, Mo, Cu and Ni stipulated in item (7) are preferably added at not less than 0.001%, 0.001% and 0.001%. When too much is added, the formability is deteriorated. Therefore, the upper limits are respectively set at 1.0%, 2.0% and 1.0%.

The type of plating stipulated by item (8) is not particularly limited. Either electric plating, hot dipping or deposition plating can provide the effect of the present invention.

Figure 3:
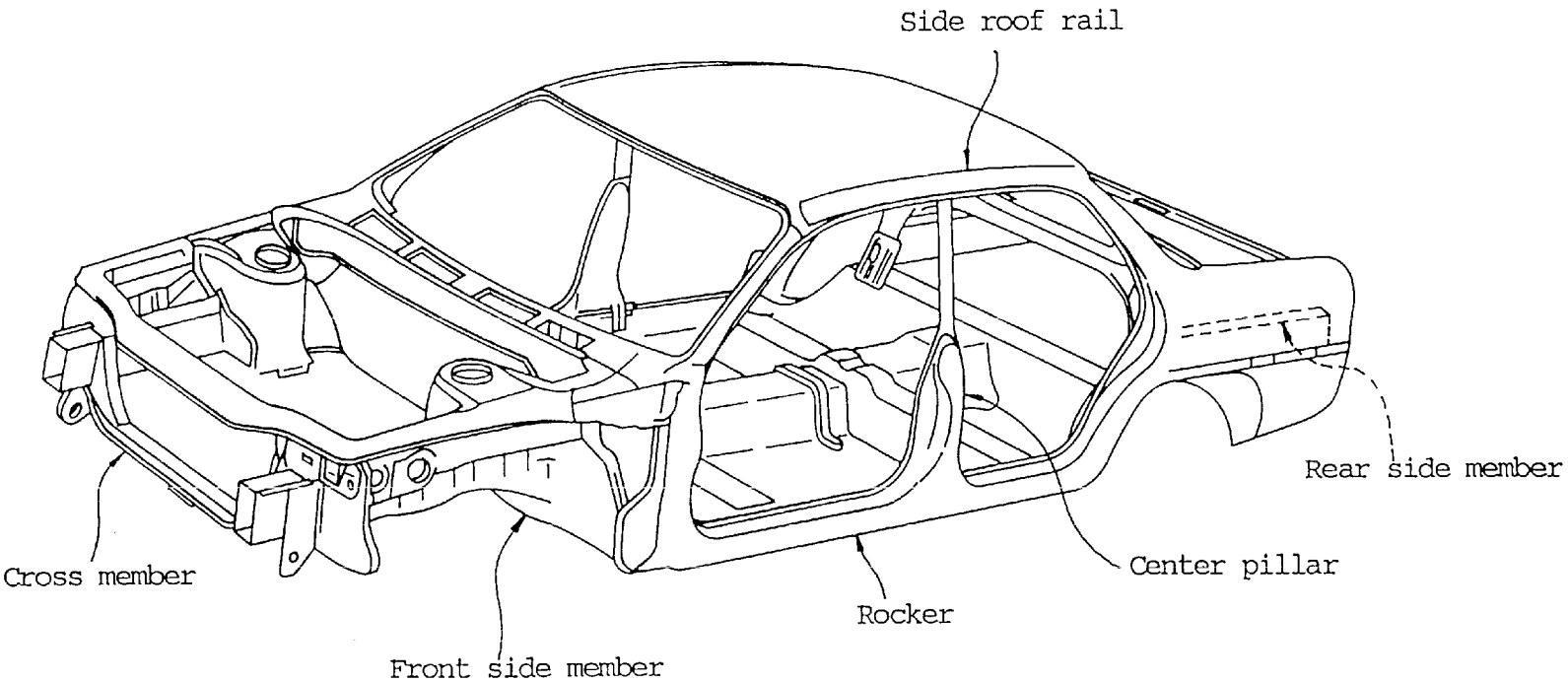
FIG. 3 is a schematic illustration showing the structural members of an automobile.

In item (9), when at least one or two of the cross member, front side member, center pillar, rocker, side roof rail and rear side member, which are shown in FIG. 3, are made of a ferritic steel sheet stipulated by the present invention, the high strength and the strain rate sensitivity can be compatible with each other. Therefore, it possible to provide an automobile that is safe even in the case of collision.

In this connection, the ferritic steel sheet according to the present invention can be used not only for automobiles but also for ships and tanks which require an impact resistant property.

EMBODIMENTS

Referring to embodiments, the technical content of the present invention will be explained below.

Concerning the embodiments, the present inventors made investigations into steels, the compositions of which are shown by items A to X on Tables 1 and 2 (continued from Table 1), containing Co and Cr in the state of solid solution. The results of the investigations will be explained as follows.

Slabs of these steels were heated in the temperature range from 900° C. to 1250° C. After heating, A, E, O, T and v were hot rolled to steel sheets of 2 mm thickness. Concerning B, C, D, F, G, H, I, J, K, L, M, N, P, Q, R, S, U, W and X, the slabs were heated in the same manner and hot-rolled to steel sheets of 3 mm thickness. The thus obtained hot-rolled steel sheets were cold-rolled to a thickness of 1.2 mm. The thus obtained cold-rolled steel sheets were continuously annealed at the soaking temperature from 700° C. to 850° C. by the continuous annealing method.

It was already known that the deformation stress in a relatively low strain region has the greatest influence on the energy absorbed by members in the case of collision and deformation. Therefore, the flow stress was set at a value of the average stress in the range from the nominal strain 5% to 10%, and a difference ($\sigma d - \sigma s$) was used as an index of the strain rate sensitivity, wherein $\sigma d$ is an average flow stress in the case of deformation at the strain rate of $10^3$/sec, and $\sigma s$ is an average flow stress in the case of deformation at the strain rate of $10^{-3}$/sec.

Figure 2:
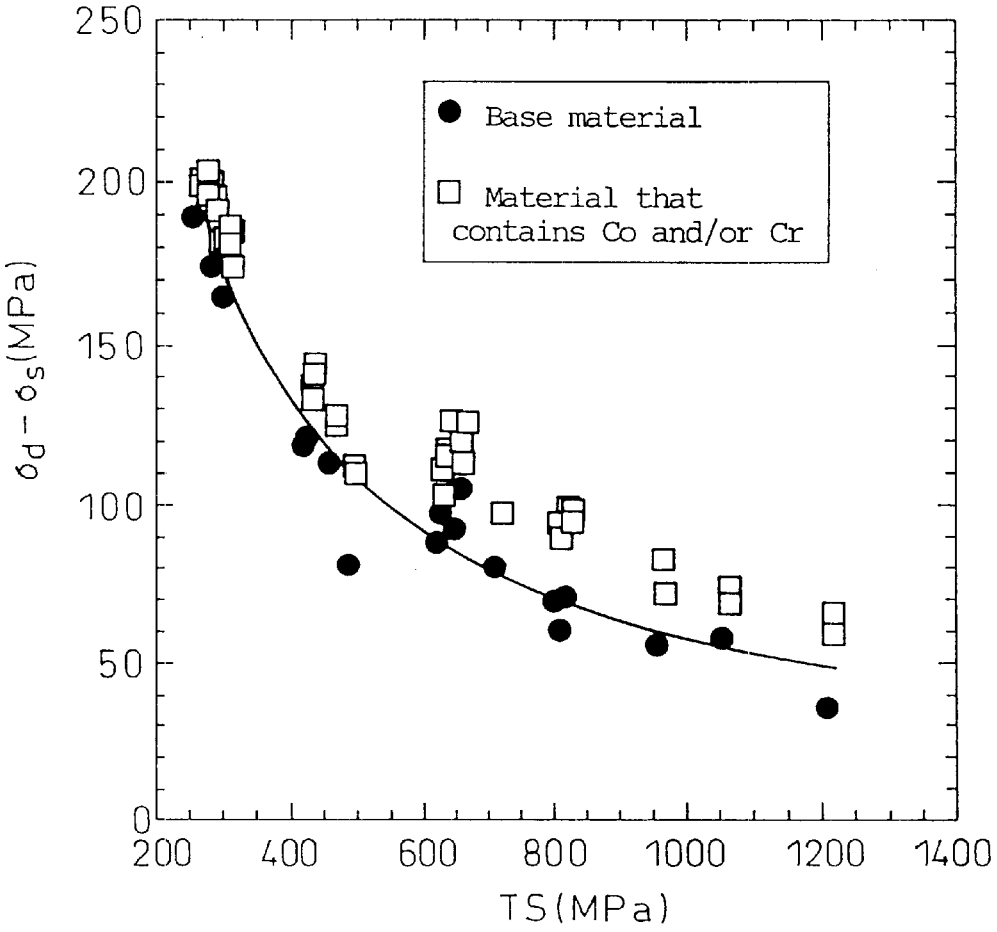
FIG. 2 is a graph showing a relation between the static strength of material and the dependency of the flow stress on a strain rate.

The results of measurement conducted on the materials, the fundamental compositions of which are shown in items A to X, which contain Co and/or Cr in the state of solid solution, are shown on Table 3, Table 4 (continued from Table 3), Table 5 (continued from able 3), Table 6 (continued from Table 3), and Table 7 (continued from Table 3). FIG. 2 shows an increase in the average flow stress with respect to tensile strength (quasi-static strength) of material when the strain rate is changed from $10^{-3}$/sec to $10^3$/sec. There is a tendency that the increase in stress is reduced in accordance with the increase in tensile strength of the material. However, with respect to the material containing Co and Cr in the state of solid solution, although tensile strength is increased as compared with the material before Co and Cr are added, the increase in flow stress is not reduced, and the strain rate sensitivity is enhanced, on the contrary.

TABLE 1

| Type of steel | Composition of steel sheet (mass %) C | Si | Mn | P | S | Al | Ti |
|---|---|---|---|---|---|---|---|
| A | 0.001 | 0.006 | 0.066 | 0.011 | 0.0012 | 0.022 | 0.024 |
| B | 0.002 | 0.003 | 0.092 | 0.006 | 0.006 | 0.024 | 0.052 |
| C | 0.028 | 0.009 | 0.172 | 0.009 | 0.015 | 0.059 | — |
| D | 0.056 | 0.015 | 0.325 | 0.013 | 0.004 | 0.027 | — |
| E | 0.081 | 0.016 | 1.46 | 0.015 | 0.004 | 0.036 | — |
| F | 0.063 | 0.02 | 0.058 | 0.11 | 0.007 | 0.056 | — |
| G | 0.091 | 0.02 | 1.86 | 0.017 | 0.017 | 0.055 | — |
| H | 0.085 | 0.02 | 2.05 | 0.02 | 0.009 | 0.002 | — |
| I | 0.12 | 0.54 | 2.01 | 0.013 | 0.016 | 0.047 | — |
| J | 0.13 | 0.64 | 2.15 | 0.02 | 0.012 | 0.038 | 0.058 |
| K | 0.15 | 0.29 | 2.28 | 0.02 | 0.018 | 0.058 | — |
| L | 0.16 | 0.59 | 2.48 | 0.019 | 0.008 | 0.045 | 0.048 |
| M | 0.002 | 0.01 | 0.86 | 0.088 | 0.019 | 0.038 | 0.056 |
| N | 0.12 | 1.22 | 1.53 | 0.021 | 0.012 | 0.044 | — |
| O | 0.15 | 1.57 | 1.02 | 0.012 | 0.001 | 0.024 | — |
| P | 0.18 | 1.25 | 2.02 | 0.015 | 0.011 | 0.039 | — |
| Q | 0.36 | 1.098 | 1.38 | 0.009 | 0.013 | 0.019 | — |
| R | 0.13 | 1.05 | 1.55 | 0.013 | 0.005 | 0.494 | 0.025 |
| S | 0.15 | 1.43 | 1.35 | 0.009 | 0.005 | 0.045 | 0.025 |
| T | 0.12 | 1.22 | 1.45 | 0.005 | 0.006 | 0.037 | 0.022 |
| U | 0.11 | 1.23 | 1.55 | 0.01 | 0.012 | 0.038 | — |
| V | 0.15 | 1.53 | 1.1 | 0.012 | 0.002 | 0.027 | — |
| W | 0.045 | 0.58 | 0.33 | 0.02 | 0.004 | 0.035 | — |
| X | 0.04 | 0.02 | 1.5 | 0.012 | 0.004 | 0.051 | — |

TABLE 2

| Type of steel | Composition of steel sheet (mass %) (Continued from Table 1) Nb | Cu | V | Mo | Ni | B | O | N |
|---|---|---|---|---|---|---|---|---|
| A | — | — | — | — | — | — | 0.0020 | 0.0027 |
| B | — | — | — | — | — | — | 0.0021 | 0.0027 |
| C | — | — | — | — | — | — | 0.0026 | 0.0025 |
| D | 0.033 | — | — | — | — | — | 0.0020 | 0.0046 |
| E | — | — | — | — | — | — | 0.0025 | 0.0036 |
| F | — | — | — | — | — | — | 0.0022 | 0.0043 |
| G | — | — | — | — | — | — | 0.0029 | 0.0035 |
| H | — | — | — | — | — | — | 0.0022 | 0.0031 |
| I | — | — | — | — | — | — | 0.0022 | 0.0035 |
| J | — | — | — | — | — | 0.024 | 0.0020 | 0.0037 |
| K | — | — | — | — | — | — | 0.0027 | 0.0028 |
| L | — | — | — | — | — | — | 0.0021 | 0.0029 |
| M | — | — | — | — | — | — | 0.0020 | 0.0038 |
| N | — | — | — | — | — | — | 0.0026 | 0.0024 |
| O | — | — | — | — | — | — | 0.0022 | 0.0035 |
| P | — | — | — | — | — | — | 0.0024 | 0.0032 |
| Q | — | — | — | — | — | — | 0.0030 | 0.0021 |
| R | — | — | — | — | — | — | 0.0022 | 0.0034 |
| S | — | — | 0.033 | — | — | — | 0.0020 | 0.0037 |
| T | — | — | 0.061 | — | — | — | 0.0021 | 0.0035 |
| U | — | 0.21 | — | — | — | — | 0.0023 | 0.0033 |
| V | — | 0.22 | — | — | — | — | 0.0025 | 0.0033 |
| W | — | — | — | 0.35 | — | — | 0.0021 | 0.0036 |
| X | — | — | — | — | 0.55 | — | 0.0025 | 0.0030 |

TABLE 3

| Type of steel | Hot-rolled or cold-rolled | Increase in average stress at strain of 5 to 10% of each material caused by an increase of strain rate: Mechanical property: Yield point (MPa) | Tensile strength (MPa) | Elongation (%) | Quantity in state of solid solution: Co (mass %) | Cr (mass %) | Increase in stress (MPa) | Invention or not of invention |
|---|---|---|---|---|---|---|---|---|
| A-1 | Hot-rolled steel sheet | 107 | 254 | 53 | | | 189 | Not of invention |
| -2 | | 106 | 265 | 55 | 0.98 | | 201 | Present invention |
| -3 | | 110 | 274 | 54 | 1.82 | | 196 | Present invention |
| -4 | | 117 | 283 | 52 | 2.93 | | 200 | Present invention |
| -5 | | 112 | 264 | 52 | | 1.09 | 199 | Present invention |
| -6 | | 113 | 276 | 51 | | 2.12 | 204 | Present invention |
| -7 | | 119 | 289 | 48 | | 3.03 | 195 | Present invention |
| -8 | | 120 | 278 | 52 | 1.04 | 1.08 | 196 | Present invention |
| B-1 | Cold-rolled steel sheet | 148 | 282 | 53 | | | 174 | Not of invention |
| -2 | | 158 | 291 | 55 | 1.00 | | 191 | Present invention |

TABLE 3-continued

Increase in average stress at strain of 5 to 10% of each material caused by an increase of strain rate

| Type of steel | Hot-rolled or cold-rolled | Mechanical property: Yield point (MPa) | Mechanical property: Tensile strength (MPa) | Mechanical property: Elongation (%) | Quantity in state of solid solution: Co (mass %) | Quantity in state of solid solution: Cr (mass %) | Increase in stress (MPa) | Invention or not of invention |
|---|---|---|---|---|---|---|---|---|
| -3 | | 163 | 305 | 54 | 2.19 | | 181 | Present invention |
| -4 | | 149 | 315 | 52 | 3.26 | | 185 | Present invention |
| -5 | | 157 | 295 | 52 | | 1.07 | 182 | Present invention |
| -6 | | 153 | 304 | 51 | | 2.02 | 183 | Present invention |
| -7 | | 175 | 314 | 48 | | 2.94 | 174 | Present invention |
| -8 | | 150 | 302 | 52 | 0.93 | 1.04 | 183 | Present invention |
| C-1 | Cold-rolled steel sheet | 171 | 299 | 50 | | | 165 | Not of invention |
| -2 | | 180 | 310 | 52 | 0.92 | | 186 | Present invention |
| -3 | | 174 | 309 | 48 | | 1.00 | 181 | Present invention |

TABLE 4

(Continued from Table 3-1)
Increase in average stress at strain of 5 to 10% of each material caused by an increase of strain rate

| Type of steel | Hot-rolled or cold-rolled | Mechanical property: Yield point (MPa) | Mechanical property: Tensile strength (MPa) | Mechanical property: Elongation (%) | Quantity in state of solid solution: Co (mass %) | Quantity in state of solid solution: Cr (mass %) | Increase in stress (MPa) | Invention or not of invention |
|---|---|---|---|---|---|---|---|---|
| D-1 | Cold-rolled steel sheet | 342 | 420 | 32 | | | 119 | Not of invention |
| -2 | | 345 | 430 | 33 | 0.93 | | 137 | Present invention |
| -3 | | 345 | 432 | 30 | | 0.96 | 133 | Present invention |
| E-1 | Hot-rolled steel sheet | 370 | 487 | 30 | | | 81 | Not of invention |
| -2 | | 379 | 495 | 31 | 0.93 | | 112 | Present invention |
| -3 | | 371 | 498 | 30 | | 1.06 | 110 | Present invention |
| F-1 | Cold-rolled steel sheet | 301 | 457 | 36 | | | 113 | Not of invention |
| -2 | | 308 | 467 | 38 | 0.97 | | 125 | Present invention |
| -3 | | 310 | 469 | 34 | | 0.92 | 128 | Present invention |
| G-1 | Cold-rolled steel sheet | 430 | 620 | 25 | | | 88 | Not of invention |
| -2 | | 434 | 629 | 25 | 0.99 | | 112 | Present invention |
| -3 | | 431 | 631 | 22 | | 0.99 | 103 | Present invention |
| H-1 | Cold-rolled steel sheet | 364 | 630 | 30 | | | 107 | Not of invention |
| -2 | | 374 | 640 | 32 | 1.10 | | 125 | Present invention |
| -3 | | 375 | 641 | 29 | | 1.08 | 124 | Present invention |
| I-1 | Cold-rolled | 510 | 811 | 24 | | | 60 | Not of invention |

TABLE 4-continued (Continued from Table 3-1)
Increase in average stress at strain of 5 to 10% of each material caused by an increase of strain rate

| Type of steel | Hot-rolled or cold-rolled | Mechanical property: Yield point (MPa) | Mechanical property: Tensile strength (MPa) | Mechanical property: Elongation (%) | Quantity in state of solid solution: Co (mass %) | Quantity in state of solid solution: Cr (mass %) | Increase in stress (MPa) | Invention or not of invention |
|---|---|---|---|---|---|---|---|---|
| -2 | steel sheet | 514 | 821 | 25 | 0.93 | | 99 | Present invention |
| -3 | | 517 | 824 | 25 | | 1.05 | 97 | Present invention |

TABLE 5

(Continued from Table 3-2)
Increase in average stress at strain of 5 to 10% of each material caused by an increase of strain rate

| Type of steel | Hot-rolled or cold-rolled | Mechanical property: Yield point (MPa) | Mechanical property: Tensile strength (MPa) | Mechanical property: Elongation (%) | Quantity in state of solid solution: Co (mass %) | Quantity in state of solid solution: Cr (mass %) | Increase in stress (MPa) | Invention or not of invention |
|---|---|---|---|---|---|---|---|---|
| J-1 | Cold-rolled | 585 | 801 | 20 | | | 69 | Not of invention |
| -2 | steel sheet | 592 | 809 | 22 | 0.94 | | 94 | Present invention |
| -3 | | 593 | 813 | 19 | | 0.95 | 89 | Present invention |
| K-1 | Cold-rolled | 635 | 1055 | 18 | | | 57 | Not of invention |
| -2 | steel sheet | 636 | 1065 | 20 | 0.91 | | 73 | Present invention |
| -3 | | 638 | 1066 | 18 | | 0.93 | 68 | Present invention |
| L-1 | Cold-rolled | 982 | 1210 | 14 | | | 35 | Not of invention |
| -2 | steel sheet | 993 | 1220 | 15 | 1.06 | | 65 | Present invention |
| -3 | | 985 | 1220 | 15 | | 0.96 | 58 | Present invention |
| M-1 | Cold-rolled | 250 | 425 | 42 | | | 121 | Not of invention |
| -2 | steel sheet | 253 | 436 | 44 | 0.98 | | 144 | Present invention |
| -3 | | 256 | 435 | 42 | | 1.06 | 141 | Present invention |
| N-1 | Cold-rolled | 406 | 634 | 37 | | | 107 | Not of invention |
| -2 | steel sheet | 408 | 646 | 37 | 1.00 | | 126 | Present invention |
| -3 | | 408 | 646 | 38 | | 1.00 | 125 | Present invention |
| O-1 | Cold-rolled | 510 | 644 | 37 | | | 105 | Not of invention |
| -2 | steel sheet | 513 | 656 | 38 | 1.01 | | 126 | Present invention |
| -3 | | 518 | 653 | 37 | | 0.99 | 126 | Present invention |

TABLE 6

(Continued from Table 3-3)
Increase in average stress at strain of 5 to 10% of each material caused by an increase of strain rate

| Type of steel | Hot-rolled or cold-rolled | Mechanical property: Yield point (MPa) | Mechanical property: Tensile strength (MPa) | Mechanical property: Elongation (%) | Quantity in state of solid solution: Co (mass %) | Quantity in state of solid solution: Cr (mass %) | Increase in stress (MPa) | Invention or not of invention |
|---|---|---|---|---|---|---|---|---|
| P-1 | Cold-rolled steel sheet | 581 | 820 | 29 | | | 70 | Not of invention |
| -2 | | 584 | 831 | 30 | 1.07 | | 98 | Present invention |
| -3 | | 592 | 830 | 28 | | 0.98 | 94 | Present invention |
| Q-1 | Cold-rolled steel sheet | 680 | 958 | 25 | | | 55 | Not of invention |
| -2 | | 681 | 967 | 24 | 0.92 | | 82 | Present invention |
| -3 | | 687 | 970 | 22 | | 1.04 | 71 | Present invention |
| R-1 | Cold-rolled steel sheet | 450 | 625 | 35 | | | 97 | Not of invention |
| -2 | | 450 | 636 | 37 | 0.95 | | 117 | Present invention |
| -3 | | 461 | 636 | 34 | | 1.09 | 115 | Present invention |
| S-1 | Cold-rolled steel sheet | 470 | 648 | 34 | | | 92 | Not of invention |
| -2 | | 472 | 659 | 35 | 1.01 | | 120 | Present invention |
| -3 | | 471 | 660 | 33 | | 0.95 | 113 | Present invention |
| T-1 | Hot-rolled steel sheet | 485 | 710 | 30 | | | 80 | Not of invention |
| -2 | | 485 | 722 | 30 | 0.96 | | 98 | Present invention |
| -3 | | 488 | 722 | 29 | | 0.95 | 97 | Present invention |
| U-1 | Cold-rolled steel sheet | 430 | 634 | 35 | | | 102 | Not of invention |
| -2 | | 433 | 647 | 34 | 1.10 | | 125 | Present invention |
| -3 | | 440 | 643 | 34 | | 0.93 | 126 | Present invention |

TABLE 7

(Continued from Table 3-4)
Increase in average stress at strain of 5 to 10% of each material caused by an increase of strain rate

| Type of steel | Hot-rolled or cold-rolled | Mechanical property: Yield point (MPa) | Mechanical property: Tensile strength (MPa) | Mechanical property: Elongation (%) | Quantity in state of solid solution: Co (mass %) | Quantity in state of solid solution: Cr (mass %) | Increase in stress (MPa) | Invention or not of invention |
|---|---|---|---|---|---|---|---|---|
| V-1 | Hot-rolled steel sheet | 495 | 657 | 32 | | | 105 | Not of invention |
| -2 | | 498 | 667 | 34 | 0.97 | | 126 | Present invention |
| -3 | | 506 | 670 | 33 | | 1.02 | 125 | Present invention |
| W-1 | Cold-rolled steel sheet | 421 | 563 | 30 | | | 89 | Not of invention |
| -2 | | 424 | 573 | 34 | 0.98 | | 105 | Present invention |
| -3 | | 429 | 575 | 33 | | 0.99 | 108 | Present invention |

TABLE 7-continued (Continued from Table 3-4)
Increase in average stress at strain of 5 to 10% of each material caused by an increase of strain rate

| Type of steel | Hot-rolled or cold-rolled | Mechanical property: Yield point (MPa) | Tensile strength (MPa) | Elongation (%) | Quantity in state of solid solution: Co (mass %) | Cr (mass %) | Increase in stress (MPa) | Invention or not of invention |
|---|---|---|---|---|---|---|---|---|
| X-1 | Cold-rolled steel sheet | 361 | 480 | 32 | | | 98 | Not of invention |
| -2 | | 363 | 490 | 34 | 0.98 | | 124 | Present invention |
| -3 | | 364 | 493 | 33 | | 1.06 | 123 | Present invention |

INDUSTRIAL POSSIBILITY

Conventionally, efforts to enhance the strength of material and efforts to enhance the strain rate sensitivity are contrary to each other. Therefore, it has been considered that enhancing the strength of material and enhancing the strain rate sensitivity are incompatible with each other. However, according to the present invention, the strength of material is enhanced and also the strain rate sensitivity is also enhanced. Therefore, the present invention can provide an effective means for enhancing an absolute value of the deformation strength in the case of deformation conducted at high strain rate which corresponds to the deformation caused in the case of collision. Accordingly, the ferritic steel sheet of the present invention can greatly contribute to an enhancement of the impact absorbing capacity, and a reduction of the weight, of an automobile body.

What is claimed is:

1. A ferritic steel sheet excellent at strain rate sensitivity comprising, in terms of mass %, C: not less than 0.0001% and not more than 0.05%, Si: not less than 0.01% and not more than 1.0%, Mn: not less than 0.01% and not more than 2.0%, P: 0.11 to 0.15%, S: not more than 0.03%, Al: not less than 0.01% and not more than 0.1%, N: not more than 0.01%, and O: not more than 0.007%, and further comprising at least one or two of the elements of:

Ti: not more than 0.20%,

Nb: not more than 0.20%,

B: not more than 0.005%,

Mo: not more than 1.0%,

Cu: not more than 2.0% and

Ni: not more than 1.0%, wherein Co and/or Cr are contained at not less than 0.01 mass % and not more than 4.0% in total in the state of solid solution in the ferrite phase, and the remainder Fe and unavoidable impurities.

2. A ferritic steel sheet excellent at strain rate sensitivity comprising, in terms of mass %, C: not less than 0.081% and not more than 0.25%, Si: not less than 0.01% and not more than 2.5%, Mn: not less than 0.01% and not more than 2.5%, P: not more than 0.15%, S: not more than 0.03%, Al: not less than 0.01% and not more than 1.0%, N: not more than 0.01%, and O: not more than 0.007%, wherein Co and/or Cr are contained by not less than 0.01% and not more than 4.0% in total in the state of solid solution in the ferrite phase, and the remainder Fe and unavoidable impurities.

3. A ferritic steel sheet excellent at strain rate sensitivity according to claim 2, further comprising, in terms of mass %, at least one or two of the elements of Ti: not more than 0.20%, Nb: not more than 0.20%, V: not more than 0.20% and B: not more than 0.005%.

4. A ferritic steel sheet excellent at strain rate sensitivity according to claim 3, further comprising, in terms of mass %, at least one or two of the elements of Mo: not more than 1%, Cu: not more than 2% and Ni: not more than 1%.

5. A ferritic steel excellent at strain rate sensitivity according to claim 1, wherein plating is conducted on the steel sheet.

6. A ferritic steel sheet excellent at strain rate sensitivity according to claim 2, wherein planting is conducted on the steel sheet.

7. An automobile characterized in that: at least one or two of the cross member, front side member, center pillar, rocker, side roof rail and rear side member are made of a ferritic steel sheet described in claim 1.

8. An automobile characterized in that: at least one or two of the cross member, from side member, center pillar, rocker, side roof rail and rear side member are made of a ferritic steel sheet described in claim 2.

* * * * *